US005717409A

United States Patent [19]

Garner et al.

[11] Patent Number: 5,717,409

[45] Date of Patent: Feb. 10, 1998

[54] DUAL FREQUENCY BAND ANTENNA SYSTEM

[75] Inventors: William J. Garner, Yardley, Pa.; Ilya A. Korisch, Stamford, Conn.

[73] Assignee: Lucent Technologies Inc., Murray Hill, N.J.

[21] Appl. No.: 691,738

[22] Filed: Aug. 2, 1996

[51] Int. Cl.[6] ..... H01Q 1/24

[52] U.S. Cl. ..... 343/702; 343/752; 343/895; 343/901

[58] Field of Search ..... 343/702, 895, 343/752, 900, 901, 715; H01Q 1/24

[56] References Cited

U.S. PATENT DOCUMENTS

| | | | |
|---|---|---|---|
| 4,121,218 | 10/1978 | Irvin et al. | 343/702 |
| 4,868,576 | 9/1989 | Johnson, Jr. | 343/702 |
| 5,317,325 | 5/1994 | Bottomley | 343/702 |
| 5,446,469 | 8/1995 | Nakio | 343/702 |
| 5,469,177 | 11/1995 | Rush et al. | 343/702 |
| 5,479,178 | 12/1995 | Ha | 343/900 |
| 5,504,494 | 4/1996 | Chatzipetros et al. | 343/895 |
| 5,594,457 | 1/1997 | Wingo | 343/895 |
| 5,606,327 | 2/1997 | Elliott et al. | 343/702 |

*Primary Examiner*—Donald T. Hajec
*Assistant Examiner*—Tan Ho

[57] ABSTRACT

A dual frequency band antennas system where the two frequency bands are not harmonically related includes first and second antenna sections. The first antenna section comprises a straight rod, with the length of the rod being at least one quarter wavelength at the center frequency of the lower of the two frequency bands. The second antenna section includes a straight portion terminated by a helical wire portion, with the total electrical length of the second antenna section being substantially equal to the length of the straight rod. A conductive antenna base is connected to at least one of the first and second antenna sections. A matching circuit coupled to the base is arranged to substantially cancel the reactive portion of the impedance of the connected antenna section for both frequency bands and to substantially equalize the resistive portion of the impedance of the connected antenna section to the resistive portion of the output impedance of the radio transceiver to which the antenna system is coupled. The lengths of the straight rod and of the second antenna section are such that together with the matching circuit the resistive portion of the impedance of the connected antenna section is substantially the same for both frequency bands.

10 Claims, 5 Drawing Sheets

DUAL FREQUENCY BAND ANTENNA SYSTEM

BACKGROUND OF THE INVENTION

This invention relates to an antenna system operable in two frequency bands and, more particularly, to such an antenna system for use in a handheld communications device and which is operable both in an extended and a retracted configuration.

In recent years, portable handheld wireless communications devices have become increasingly popular. At the present time, cellular telephones operating in the frequency band of 824 MHz through 896 MHz are the most widespread type of such devices. However, the personal communications system (PCS) operating in the frequency band of 1850 MHz through 1990 MHz is gaining in popularity. Accordingly, equipment suppliers are developing portable handheld radio transceivers which operate in both these frequency bands. Accordingly, there exists a need for an antenna system capable of operating in both of the described frequency bands.

If the center frequencies of the two frequency bands were harmonically related, it would be a relatively simple matter to design an antenna operable for both of the bands. However, for the frequency bands discussed above, where the ratio between the center frequencies of the two bands is in the range between two and three, such a harmonic relationship does not exist. Accordingly, there exists another need for an antenna system operable for two frequency bands which are not harmonically related.

Handheld portable radio transceivers must be designed in accordance with certain human factors considerations. Thus, such a device should be compact and lightweight. It is known to design such a device with a rod (or whip) antenna which is selectively retractable into or extendable out of the device case. Frequently, the user wishes to keep the transceiver turned on so that a call can be received and the user be notified of such receipt, but at the same time retract the antenna into the case so that the transceiver can be placed in a pocket or a purse. Thus, there exists a further need for a retractable antenna system which is operable in two frequency bands which are not harmonically related.

SUMMARY OF THE INVENTION

In accordance with the principles of this invention, there is provided a dual frequency band antenna system for use in a radio transceiver device wherein the two frequency bands are not harmonically related and the ratio between center frequencies of the two frequency bands is in the range from about two to about three. The inventive antenna system comprises a first antenna radiating section and a second antenna radiating section. The first antenna section includes a straight rod, with the length of the rod being at least one quarter wavelength at the center frequency of the lower of the two frequency bands. The second antenna section includes a straight portion coupled to the radio transceiver device and terminated by a helical wire portion, the straight portion being parallel to and spaced from the axis of the helical wire portion, with the total electrical length of the second antenna section being substantially equal to the length of the straight rod. A conductive antenna base is connected to at least one of the first and second antenna sections. A matching circuit is coupled between the radio transceiver device and the antenna base. The matching circuit is arranged to substantially cancel the reactive portion of the impedance of the connected antenna section for both frequency bands and to substantially equalize the resistive portion of the impedance of the connected antenna section to the resistive portion of the output impedance of the radio transceiver device. The lengths of the straight rod and of the second antenna section are such that together with the matching circuit the resistive portion of the impedance of the connected antenna section is substantially the same for both frequency bands.

In accordance with an aspect of this invention, the radio transceiver device includes an outer case and a printed circuit board mounted within the case and containing thereon transceiver circuitry including an antenna feed. The matching circuit is mounted on the printed circuit board and is connected to the antenna feed. The antenna system further comprises first coupling means for coupling the straight rod of the first antenna section to the antenna base and second coupling means for coupling the straight portion of the second antenna section to the antenna base.

In accordance with another aspect of this invention, the straight portion of the second antenna section is fixedly mounted to the case and the straight rod of the first antenna section extends axially through the helical wire portion of the second antenna section, with the straight rod being selectively retractable into the case and extendable out of the case. The first coupling means includes means for uncoupling the straight rod of the first antenna section from the base when the straight rod is retracted into the case. Thus, when the straight rod is retracted, only the second antenna section is operatively coupled to the transceiver circuitry.

DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
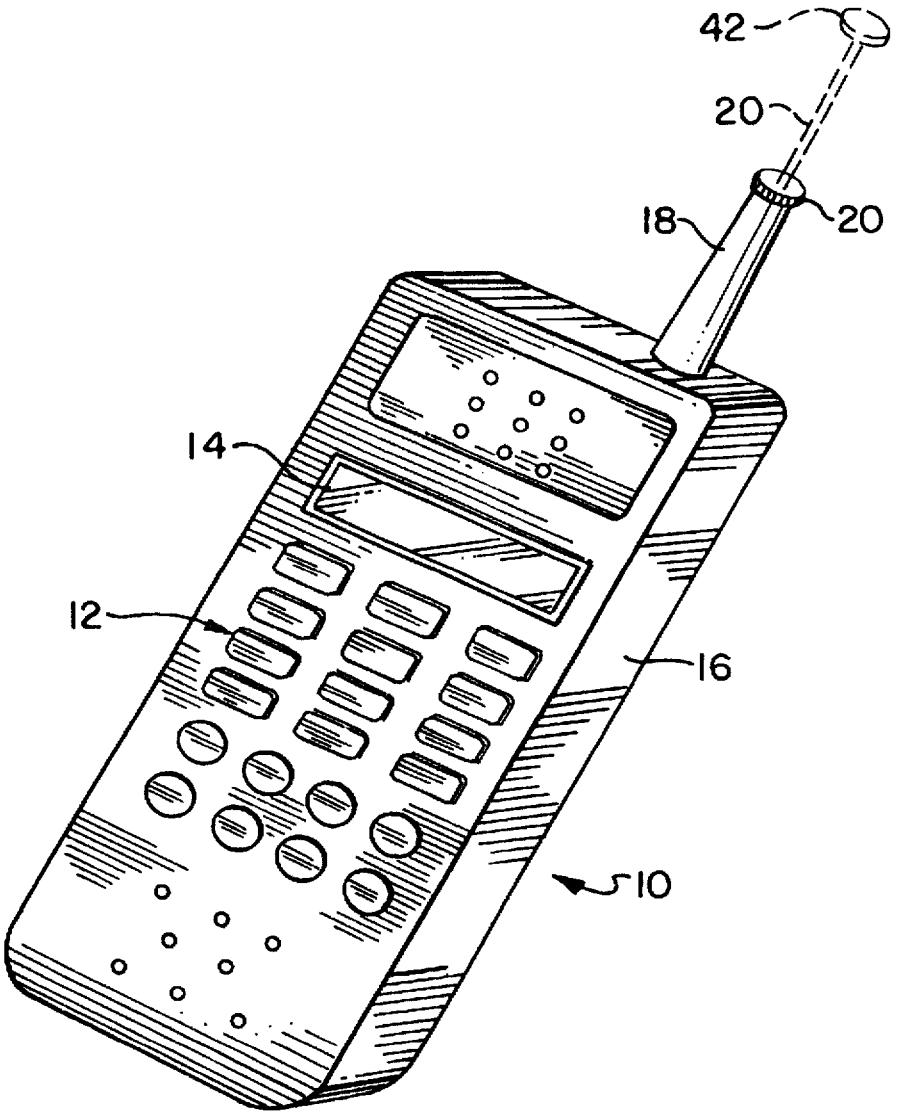
FIG. 1 is a perspective view of a handheld communications device in which an antenna system constructed in accordance with the principles of this invention is incorporated.

Referring now to the drawings, FIG. 1 shows a handheld portable communications device, designated generally by the reference numeral 10, having a data entry keypad 12 and a display 14 disposed on one surface of the case 16. An antenna tower 18 is mounted to the upper surface of the case 16. As will be described in full detail hereinafter, the tower 18 contains the second antenna section of the antenna system according to this invention and allows the first antenna section 20 to be selectively retracted into and extended out of the case 16.

Figure 2:
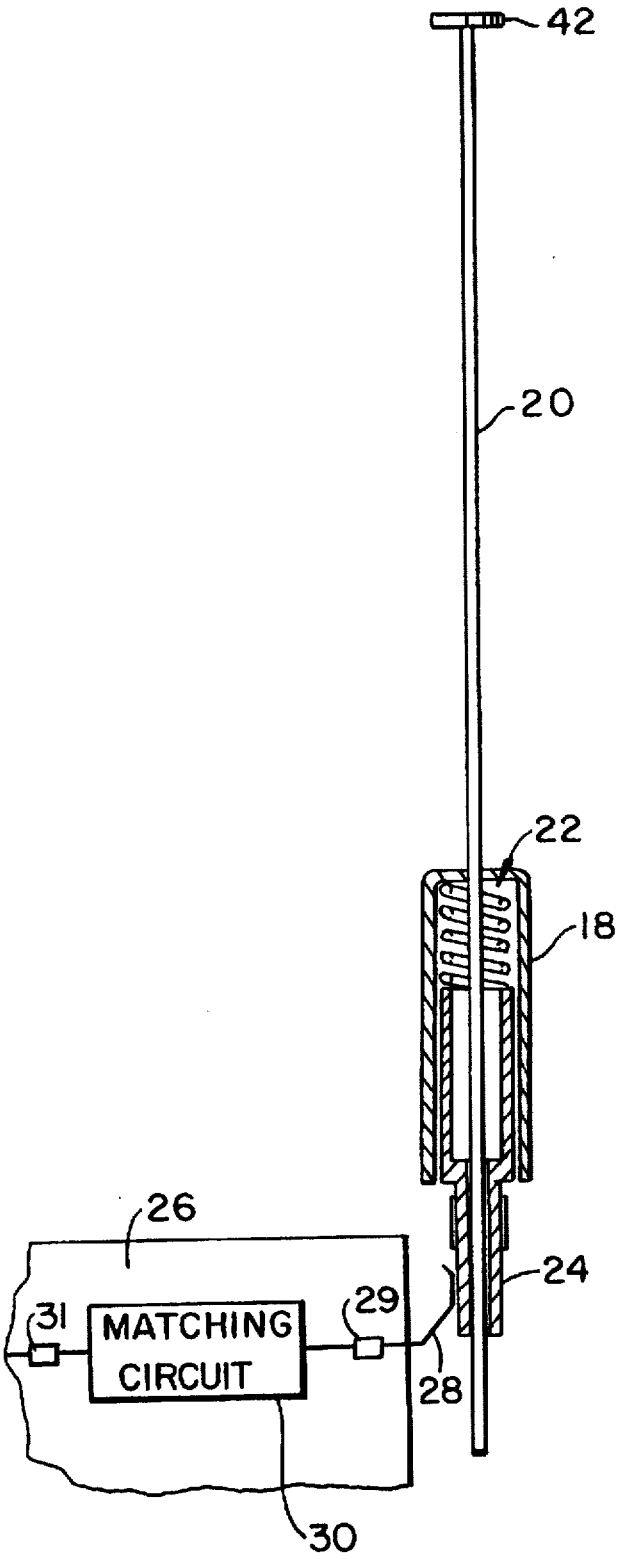
FIG. 2 is a schematic cross sectional view of an illustrative antenna system according to this invention showing an arrangement for coupling the antenna system to a printed circuit board within the handheld communications device.

As shown schematically in FIG. 2, the second antenna section 22 is contained within the tower 18 and the first antenna section 20 is selectively longitudinally movable. The conductive antenna system base 24 is coupled to circuitry on the printed circuit board 26, which is within the case 16 and supports transceiver circuitry (not shown) thereon, illustratively via a spring clip 28 and through the terminal 29 and the matching circuit 30, which is connected to the antenna feed terminal 31 of the transceiver circuitry. As will be described hereinafter, at least one of the first antenna section 20 and the second antenna section 22 is connected to the antenna base 24.

Figure 3:
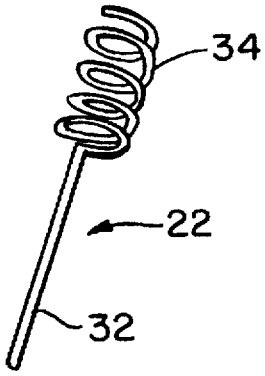
FIG. 3 is a perspective view of a first embodiment of the second antenna section according to this invention.
Figure 4:
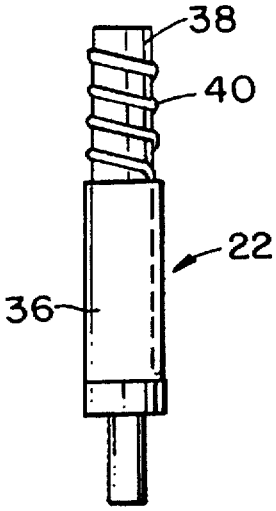
FIG. 4 is a perspective view of a second embodiment of the second antenna section according to this invention.

The second antenna section 22 includes a straight portion which is coupled at a first end to the base 24 and is terminated at a second end by a helical wire portion. In a first embodiment, as shown in FIG. 3, the second antenna section 22 is formed from a single wire having a straight portion 32 and a helical portion 34. The total combined electrical length of the portions 32, 34 of the second antenna section 22 is substantially equal to the length of the straight rod which makes up the first antenna section 20. In a second embodiment of the second antenna section 22, as shown in FIG. 4, the straight portion is made up of a section of sheet metal 36, preferably copper, acting as the straight portion and wrapped on an insulating cylindrical form 38 to form a hollow cylindrical arc segment. A helical wire 40 is also wrapped around the form 38 and is connected at one end to the straight portion 36. In both of the embodiments (FIGS. 3 and 4) of the second antenna section 22, the respective straight portion 32, 36 is parallel to and spaced from the axis of the respective helical portion 34, 40. Preferably, this spacing is equal to the radius of the helical portion.

As is conventional, the first antenna section 20 includes a straight rod. Preferably, the rod is contained within an insulating plastic sleeve, with the sleeve being longer than the rod and being terminated by a cap 42 which aids the user in extending and retracting the first antenna section 20. The straight rod of the first antenna section 20 is selected to have a length which is at least one quarter wavelength at the center frequency of the lower of the two frequency bands in which the communications device 10 operates. In particular, it has been found that when the electrical length of the straight rod is in the range from about 0.28 through 0.32 of the wavelength of the lower frequency band center frequency, corresponding to a range from about 0.625 through 0.75 of the wavelength of the center frequency of the higher frequency band, the current distribution at the antenna system base 24 is sufficient for proper operation.

Figure 5:
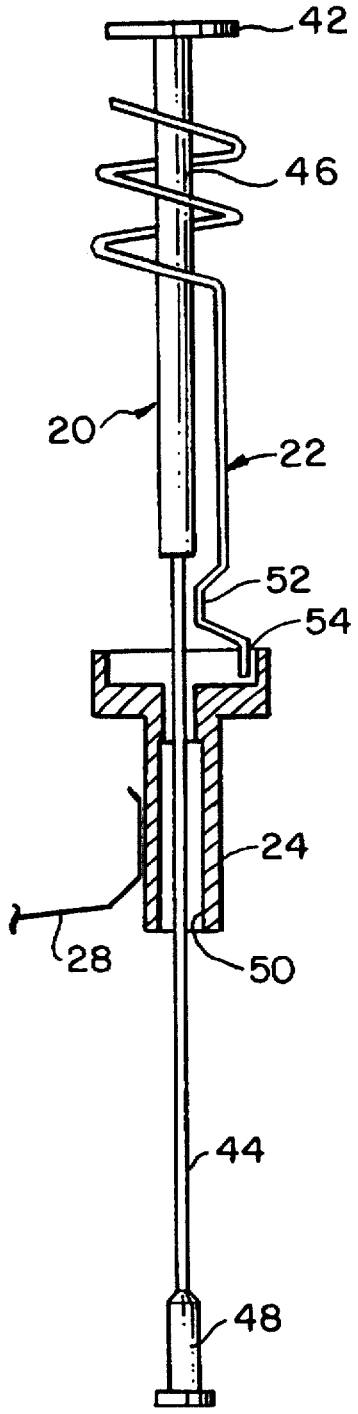
FIG. 5 is a schematic cross sectional view of an embodiment of the antenna system according to this invention wherein the second antenna section is coupled to the transceiver circuitry when the first antenna section is fully retracted and is otherwise uncoupled.

As shown in FIG. 2, the second antenna section 22 may be permanently and directly coupled to the transceiver circuitry through the base 24 and the matching circuit 30. Alternatively, the coupling of the base 24 to the matching circuit 30 may be either capacitive or inductive. Further, it may be desired to couple the first antenna section 20 and the second antenna section 22 to the base 24 (and therethrough to the transceiver circuitry) by a switching action as a function of the extended or retracted status of the first antenna section 20. FIG. 5 shows an arrangement wherein the second antenna section 22 is coupled to the base 24 only when the first antenna section 20 is fully retracted. Thus, as shown, the antenna system base 24 is coupled to the spring clip 28. The first antenna section 20 includes a straight rod 44 with an insulating sleeve 46 of enlarged diameter at its upper end, the sleeve 46 being terminated by the cap 42. At its lower end, the rod 44 is terminated by a conductive plug 48 which is drawn into the enlarged bore 50 of the base 24 when the first antenna section 20 is extended, making electrical contact with the base 24 so that the first antenna section 20 is coupled to the transceiver circuitry on the printed circuit board 26. At this time, the second antenna section 22 is maintained out of contact with the base 24, as shown. However, when the first antenna section 20 is retracted into the tower 18 (not shown in FIG. 5), the sleeve 46 engages the inwardly directed portion 52 of the second antenna section 22, pushing it outwardly so that the end 54 of the second antenna section 22 engages the base 24.

Figure 6:
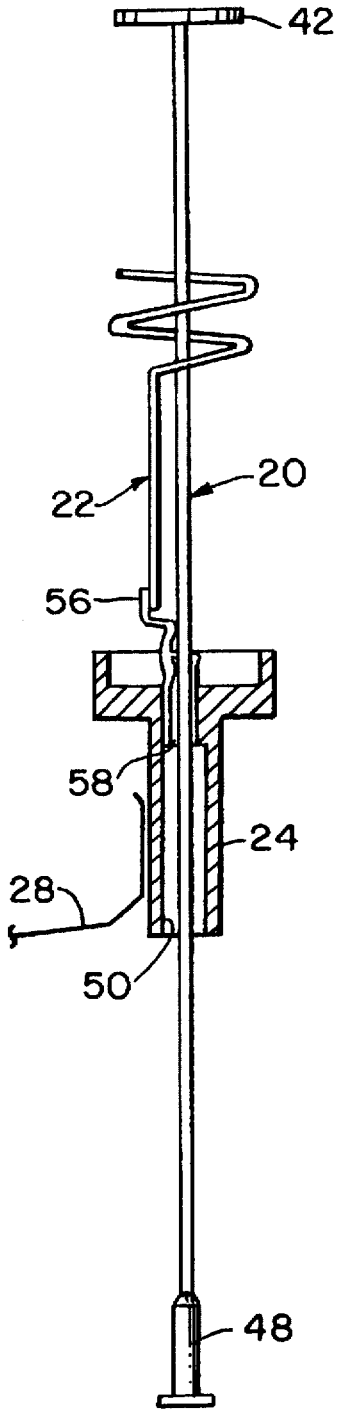
FIG. 6 is a schematic cross sectional view of another embodiment of the antenna system according to this invention wherein the second antenna section is uncoupled from the transceiver circuitry when the first antenna section is fully extended and is otherwise coupled.

FIG. 6 illustrates an arrangement wherein the second antenna section 22 is normally coupled to the base 24 and is uncoupled when the first antenna section 20 is fully extended. Thus, the second antenna section 22 is normally in contact with the conductive spring contact member 56, whose lower end is held within the small bore 58 of the base 24, so that the second antenna section 22 is coupled to the transceiver circuitry through the base 24 and the spring clip 28. When the first antenna section 20 is fully extended, the conductive plug 48 is pulled into the enlarged bore 50 of the base 24 and then into the small bore 58. When the plug 48 is within the bore 58, it pushes the spring contact member 56 outwardly out of engagement with the second antenna section 22, thereby uncoupling the second antenna section 22 from the base 24.

Figure 7:
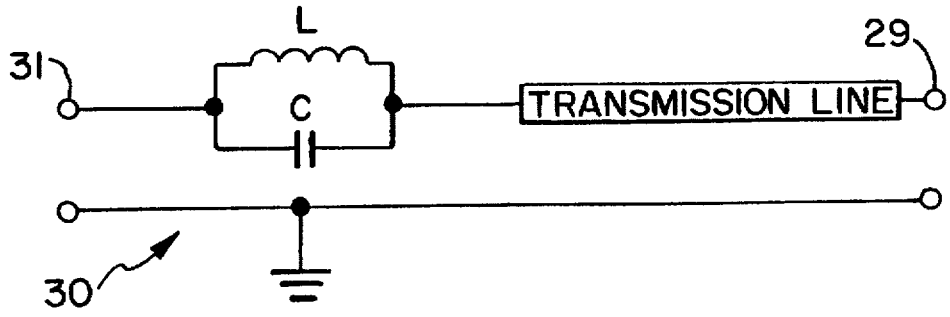
FIG. 7 is a schematic electrical circuit diagram showing a first embodiment of a matching circuit for use with the antenna system according to this invention.
Figure 8:
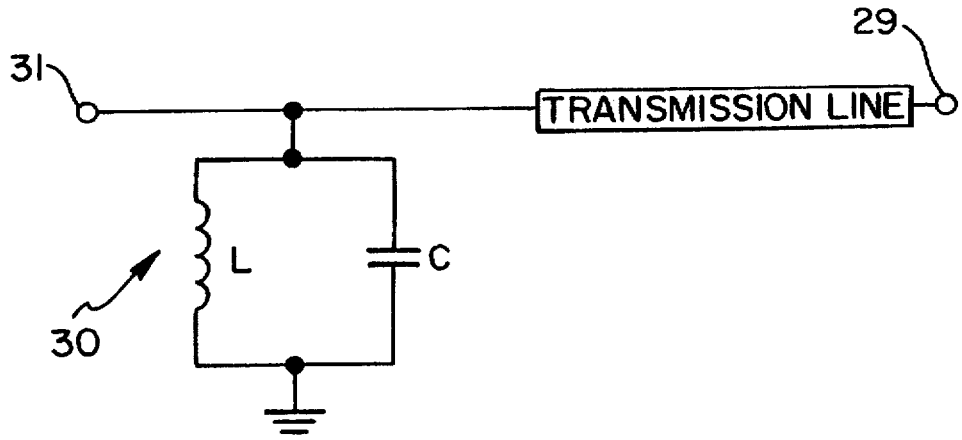
FIG. 8 is a schematic electrical circuit diagram showing a second embodiment of a matching circuit for use with the antenna system according to this invention.

As previously discussed, there is a matching circuit 30 on the printed circuit board 26 coupled between the antenna system and the transceiver circuitry. Viewed from the terminal 29 connected to the base 24, at the lower center frequency $f_1$ the impedance of the antenna system is $R_1+jX_1$, and at the higher center frequency $f_2$ the impedance of the antenna system is $R_2+jX_1$. The antenna system components and the matching circuit 30 are selected so that $R_1$ and $R_2$ are transformed to become substantially equal to $R_0$ at the terminal 31, where $R_0$ is the resistive portion of the output impedance of the transceiver circuitry at the antenna feed terminal 31. The matching circuit 30 is further designed so that at the frequency $f_1$, the matching circuit 30 cancels the reactive component $jX_1$ and at the frequency $f_2$ the matching circuit 30 cancels the reactive component $jX_1$. FIGS. 7 and 8 illustrate two possible configurations for the matching circuit 30, both of which include a tank circuit and a section of transmission line. The characteristic impedance and length of the section of transmission line, which is basically a sort of phase shifter, are chosen to equalize the resistive portion of the antenna impedance at the center frequencies of the two frequency bands. The tank circuit compensates for the remaining reactance.

Figure 9:
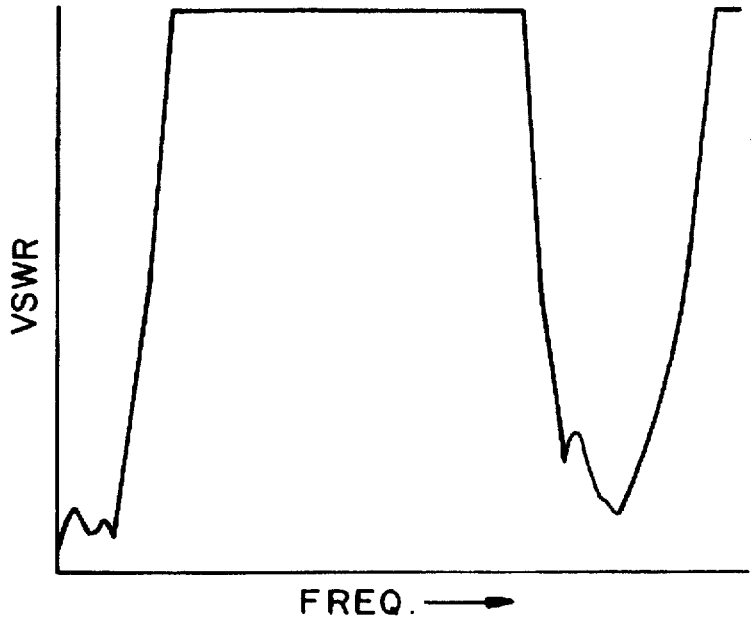
FIG. 9 is a waveform showing the voltage standing wave ratio (VSWR) versus frequency for the antenna system of this invention with the first antenna section fully extended.
Figure 10:
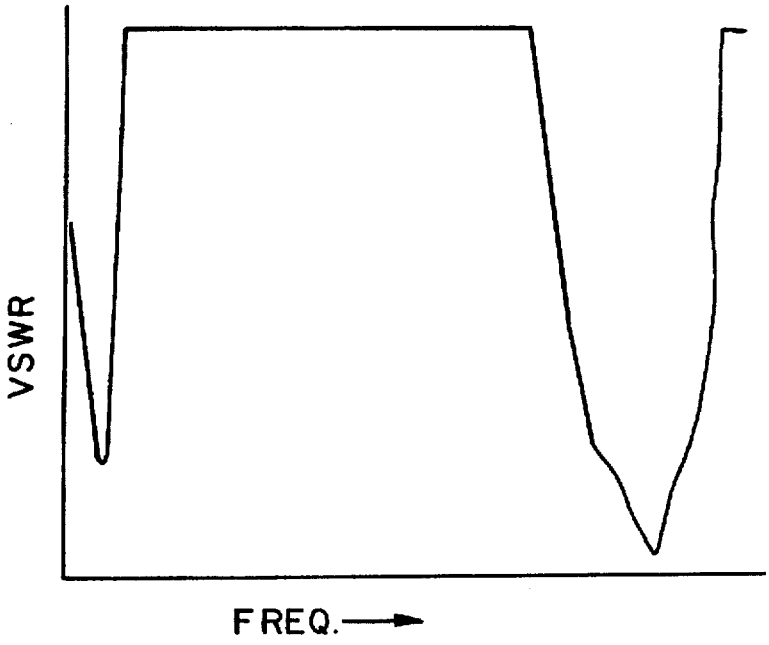
FIG. 10 is a waveform showing the voltage standing wave ratio (VSWR) versus frequency for the antenna system of this invention with the first antenna section fully retracted.

FIG. 9 illustrates the resonant behavior (frequency v. voltage standing wave ratio) for the aforedescribed antenna system at the two frequency bands when the first antenna section 20 is fully extended and FIG. 10 illustrates the resonant behavior when the first antenna section 20 is fully retracted. It is noted that satisfactory operation is attained at both frequency bands for both conditions of the antenna system. It has been found that the dimensions of the second antenna system 22 can be varied to vary the bandwidths (FIGS. 9 and 10) at the two frequency bands of interest. Thus, by controlling the ratio of the lengths of the helical portion and the straight portion of the second antenna section 22, one can control the relative bandwidths at the two center frequencies. Further, by controlling the overall diameter of the helical portion of the second antenna system 22, one can control the overall bandwidths in both frequency bands.

Accordingly, there has been disclosed an improved dual frequency band antenna system operable in both an extended and a retracted configuration. While illustrative embodiments of the present invention have been disclosed herein, it is understood that various modifications and adaptations to the disclosed embodiments will be apparent to one of ordinary skill in the art and it is intended that this invention be limited only by the scope of the appended claims.

What is claimed is:

1. A dual frequency band antenna system for use in a radio transceiver device wherein the two frequency bands are not harmonically related and the ratio between center frequencies of the two frequency bands is in the range from about two to about three, the antenna system comprising:

a first antenna radiating section including a straight rod, the length of said straight rod being at least one quarter wavelength at the center frequency of the lower of the two frequency bands;

a second antenna radiating section including a straight portion coupled to said radio transceiver device and terminated by a helical wire portion, the straight portion being parallel to and spaced from the axis of the helical wire portion, the total electrical length of said second antenna section being substantially equal to the length of said straight rod;

a conductive antenna base;

means for connecting at least one of said first and second antenna sections to said base; and a matching circuit coupled between said radio transceiver device and said base, said matching circuit being arranged to substantially cancel the reactive portion of the impedance of the connected antenna section for both frequency bands and to substantially equalize the resistive portion of the impedance of the connected antenna section to the resistive portion of the output impedance of the radio transceiver device;

wherein the length of said straight rod and of said second antenna section are such that together with said matching circuit the resistive portion of the impedance of the connected antenna section is substantially the same for both frequency bands.

2. The antenna system according to claim 1 wherein:

said radio transceiver device includes an outer case and a printed circuit board mounted within said case and containing thereon transceiver circuitry including an antenna feed;

said matching circuit is mounted on said printed circuit board and is connected to said antenna feed; and said antenna system further comprises;

first coupling means for coupling the straight rod of said first antenna section to said base; and second coupling means for coupling the straight portion of said second antenna section to said base.

3. The antenna system according to claim 2 wherein:

said straight portion of said second antenna section is fixedly mounted to said case;

said straight rod of said first antenna section extends axially through the helical wire portion of said second antenna section;

said straight rod is selectively retractable into said case and extendable out of said case; and said first coupling means includes means for uncoupling the straight rod of said first antenna section from said base when said straight rod is retracted into said case.

4. The antenna system according to claim 3 wherein:

said second coupling means includes means for uncoupling the straight portion of said second antenna section from said base when said straight rod is extended out of said case.

5. The antenna system according to claim 1 wherein:

a first of said frequency bands covers the range from about 824 MHz through about 896 MHz;

the second of said frequency bands covers the range from about 1850 MHz through about 1990 MHz; and the length of said straight rod is in the range from about 0.28 through about 0.32 of the wavelength at 850 MHz.

6. The antenna system according to claim 1 wherein the ratio of the length of the straight portion to the helical wire portion of the second antenna section is selected to achieve desired bandwidths in the two frequency bands.

7. The antenna system according to claim 1 wherein the straight portion of said second antenna section comprises a straight wire.

8. The antenna system according to claim 7 wherein said straight wire is spaced from the axis of said helical wire portion by a distance substantially equal to the radius of said helical wire portion.

9. The antenna system according to claim 1 wherein the straight portion of said second antenna section comprises a hollow cylindrical arc segment co-axial with the axis of the helical wire portion.

10. The antenna system according to claim 9 wherein the radius of the hollow cylindrical arc segment is substantially equal to the radius of the helical wire portion.

* * * * *